US011761300B2

(12) United States Patent
Prost

(10) Patent No.: US 11,761,300 B2
(45) Date of Patent: Sep. 19, 2023

(54) FULL BORE ELECTRIC FLOW CONTROL VALVE SYSTEM

(71) Applicant: Schlumberger Technology Corporation, Sugar Land, TX (US)

(72) Inventor: Jerome Prost, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 47 days.

(21) Appl. No.: 17/253,147

(22) PCT Filed: Jun. 21, 2019

(86) PCT No.: PCT/US2019/038438
§ 371 (c)(1),
(2) Date: Dec. 17, 2020

(87) PCT Pub. No.: WO2019/246501
PCT Pub. Date: Dec. 26, 2019

(65) Prior Publication Data

US 2021/0254431 A1 Aug. 19, 2021

Related U.S. Application Data

(60) Provisional application No. 62/688,843, filed on Jun. 22, 2018.

(51) Int. Cl.
*E21B 34/06* (2006.01)
*E21B 34/14* (2006.01)
*E21B 43/14* (2006.01)

(52) U.S. Cl.
CPC ..... *E21B 34/066* (2013.01); *E21B 34/14* (2013.01); *E21B 43/14* (2013.01); *E21B 2200/06* (2020.05)

(58) Field of Classification Search
CPC ..... E21B 34/066; E21B 34/14; E21B 43/14; E21B 2200/06; E21B 43/12
See application file for complete search history.

(56) References Cited

U.S. PATENT DOCUMENTS 3,417,827 A * 12/1968 Smith ..... E21B 47/06 166/128
4,796,699 A * 1/1989 Upchurch ..... E21B 41/00 166/264

(Continued)

FOREIGN PATENT DOCUMENTS

KR 1020140033910 3/2014
RU 2540762 C2 2/2015

(Continued)

OTHER PUBLICATIONS

International Preliminary Report on Patentability issued in PCT/US2019/038438, dated Dec. 30, 2020 (9 pages).

(Continued)

*Primary Examiner* — Jonathan Malikasim
(74) *Attorney, Agent, or Firm* — Jeffrey D. Frantz

(57) ABSTRACT

A technique facilitates flow control downhole via at least one flow control valve. According to an example, a flow control valve has an internal piston. Additionally, an electrically powered actuator is mounted externally to the flow control valve and connected to the internal piston via a linkage. The electrically powered actuator is responsive to electrical inputs to shift the internal piston to desired flow positions of the flow control valve.

16 Claims, 9 Drawing Sheets

(56) References Cited

U.S. PATENT DOCUMENTS

| | | | | |
|---|---|---|---|---|
| 5,293,551 | A | 3/1994 | Perkins et al. | |
| 5,358,035 | A | 10/1994 | Grudzinski | |
| 5,832,996 | A * | 11/1998 | Carmody | E21B 34/066 137/625.68 |
| 5,906,238 | A | 5/1999 | Carmody et al. | |
| 6,148,843 | A * | 11/2000 | Pringle | E21B 43/123 137/155 |
| 6,152,224 | A | 11/2000 | French | |
| 6,176,318 | B1 | 1/2001 | Drakeley et al. | |
| 6,199,628 | B1 | 3/2001 | Beck et al. | |
| 6,269,874 | B1 * | 8/2001 | Rawson | E21B 34/066 166/332.6 |
| 6,273,194 | B1 | 8/2001 | Hiron et al. | |
| 6,405,803 | B1 | 6/2002 | Giroux et al. | |
| 6,422,317 | B1 | 7/2002 | Williamson, Jr. | |
| 6,484,800 | B2 | 11/2002 | Carmody et al. | |
| 6,494,265 | B2 | 12/2002 | Wilson et al. | |
| 6,543,544 | B2 | 4/2003 | Schultz et al. | |
| 6,648,073 | B1 | 11/2003 | Jernigan et al. | |
| 6,691,587 | B1 | 2/2004 | King | |
| 6,715,558 | B2 | 4/2004 | Williamson | |
| 6,763,892 | B2 | 7/2004 | Kaszuba | |
| 6,869,063 | B2 | 3/2005 | Gunnarsson et al. | |
| 6,951,331 | B2 | 10/2005 | Haughom et al. | |
| 7,055,598 | B2 | 6/2006 | Ross et al. | |
| 7,377,327 | B2 | 5/2008 | Jackson | |
| 7,445,047 | B2 | 11/2008 | Gomez | |
| 8,281,863 | B2 | 10/2012 | Voss | |
| 8,505,294 | B2 | 8/2013 | Willauer et al. | |
| 8,757,278 | B2 | 6/2014 | Smithson | |
| 8,978,750 | B2 * | 3/2015 | Noske | E21B 34/06 175/57 |
| 9,222,340 | B2 | 12/2015 | Holderman et al. | |
| 9,228,423 | B2 * | 1/2016 | Powell | E21B 34/066 |
| 9,376,889 | B2 | 6/2016 | Reid et al. | |
| 9,540,912 | B2 | 1/2017 | Fripp et al. | |
| 10,100,608 | B2 | 10/2018 | Fripp et al. | |
| 10,132,420 | B2 | 11/2018 | Long | |
| 10,287,851 | B2 * | 5/2019 | El Mallawany | E21B 34/10 |
| 10,358,899 | B2 | 7/2019 | El Mallawany et al. | |
| 10,563,481 | B2 * | 2/2020 | Richards | E21B 47/06 |
| 10,570,698 | B2 | 2/2020 | Peyregne et al. | |
| 10,670,160 | B2 * | 6/2020 | Phelps | F16K 17/36 |
| 10,745,998 | B2 * | 8/2020 | Prost | E21B 41/00 |
| 10,830,012 | B2 | 11/2020 | Holmes et al. | |
| 10,907,444 | B1 | 2/2021 | Brown | |
| 10,961,819 | B2 | 3/2021 | Honeker et al. | |
| 10,995,584 | B2 | 5/2021 | Noel | |
| 10,995,586 | B2 | 5/2021 | Gonzales Panta et al. | |
| 11,105,183 | B2 | 8/2021 | Frosell et al. | |
| 2002/0108747 | A1 | 8/2002 | Dietz et al. | |
| 2003/0019622 | A1 | 1/2003 | Goodson, Jr. et al. | |
| 2004/0173362 | A1 * | 9/2004 | Waithman | E21B 34/066 166/386 |
| 2007/0056745 | A1 * | 3/2007 | Contant | E21B 47/18 166/382 |
| 2008/0053662 | A1 | 3/2008 | Williamson et al. | |
| 2009/0078427 | A1 | 3/2009 | Patel | |
| 2009/0301732 | A1 | 12/2009 | Turner et al. | |
| 2010/0038093 | A1 | 2/2010 | Patel | |
| 2010/0236790 | A1 | 9/2010 | Smithson | |
| 2012/0037360 | A1 | 2/2012 | Arizmendi, Jr. et al. | |
| 2012/0067593 | A1 * | 3/2012 | Powell | E21B 34/066 166/373 |
| 2014/0034308 | A1 | 2/2014 | Holderman et al. | |
| 2015/0198016 | A1 | 7/2015 | Langlais | |
| 2016/0245076 | A1 | 8/2016 | Logan et al. | |
| 2017/0044869 | A1 | 2/2017 | Patel | |
| 2018/0223625 | A1 * | 8/2018 | Noel | E21B 34/066 |
| 2018/0245428 | A1 | 8/2018 | Richards | |
| 2018/0283137 | A1 | 10/2018 | Peyregne et al. | |
| 2020/0355054 | A1 * | 11/2020 | Fripp | E21B 47/06 |
| 2020/0392812 | A1 * | 12/2020 | Vick, Jr. | F04C 2/16 |
| 2021/0115767 | A1 * | 4/2021 | Tajallipour | E21B 47/18 |
| 2021/0198975 | A1 | 7/2021 | Honeker et al. | |
| 2021/0222515 | A1 | 7/2021 | Honeker et al. | |
| 2021/0254432 | A1 | 8/2021 | Honeker et al. | |
| 2021/0324708 | A1 | 10/2021 | Candido Gomes | |

FOREIGN PATENT DOCUMENTS

| | | | |
|---|---|---|---|
| RU | 2620700 | C1 | 5/2017 |
| WO | 2017058258 | A1 | 4/2017 |
| WO | 2017070766 | A1 | 5/2017 |
| WO | 2019125465 | A1 | 6/2019 |
| WO | 2019246501 | A1 | 12/2019 |
| WO | 2021262703 | A1 | 12/2021 |
| WO | 2022006529 | A1 | 1/2022 |

OTHER PUBLICATIONS

International Search Report and Written Opinion of PCT Application No. PCT/US2021/040319 dated Oct. 19, 2021, 10 pages.
International Search Report and Written Opinion of PCT Application No. PCT/US2021/038459 dated Sep. 27, 2021, 10 pages.
"What is a 3-way Solenoid Valve", downloaded from the internet at [https://web.archive.org/web/20170802031323/https://instrumentationtools.com/3-way-solenoid-valve/] retrieved on May 18, 2022, 6 pages.
International Search Report and Written Opinion issued in PCT/US2019/038438, dated Oct. 2, 2019 (12 pages).

* cited by examiner

FULL BORE ELECTRIC FLOW CONTROL VALVE SYSTEM

CROSS-REFERENCE TO RELATED APPLICATIONS

The present application claims priority benefit of U.S. Provisional Application No. 62/688,843, filed Jun. 22, 2018, the entirety of which is incorporated by reference herein and should be considered part of this specification.

BACKGROUND

An oil well may have multiple production zones or intervals. It is of interest for the operator to be able to produce these zones altogether (commingled production) to maximize production and the return on investment made in such well. The different producing zones may have different pressures and may deplete at different rates. To optimize production or even shut off a water producing zone, the operator relies on downhole flow control valves (FCVs) that control the flow of hydrocarbon from each producing interval into the production tubing string. The same applies for an injection well where selective and controlled injection into the different intervals involves controlling the flow of fluid at each interval.

FCVs are traditionally hydraulically operated from surface by hydraulic control lines running from in the well and fed through the well head and packers. Because the number of penetrators or allowable control lines is limited, this may restrict the number of valves that can be installed in a well. Moreover, such a well often includes chemical injection lines and electrical cable for communication and power of downhole sensors, thus restricting even further the number of hydraulic penetrations left at the well head or packer.

SUMMARY

In general, a system and methodology are provided for facilitating flow control downhole. According to an embodiment, a flow control valve has an internal piston. Additionally, an electrically powered actuator is mounted externally to the flow control valve and connected to the internal piston via a linkage. The electrically powered actuator responds to electrical inputs to shift the internal piston to desired flow positions of the flow control valve.

The flow control valve can include a housing, with the internal piston movably disposed within the housing. The actuator can be held in place along an outer surface of the housing with one or more clamps or protectors. An outer surface of the housing can include one or more grooves. The actuator can be disposed in one of the one or more grooves. The outer surface of the housing can have a first groove housing the actuator and a second groove housing electronics and/or sensors.

The actuator can be an electro-mechanical actuator (EMA) or an electro-hydraulic actuator (EHA).

A system including the flow control valve and actuator can further include a pump system and a manifold. The pump system includes a motor and a pump. The manifold includes hydraulic circuitry that links the pump system to the actuator. The pump system is configured to pump hydraulic control fluid from a reservoir through the manifold to the actuator. The manifold can include at least one solenoid operated valve (SOV).

Mechanical intervention for mechanically shifting the flow control valve can be performed while the actuator is connected to the internal piston of the flow control valve. In some configurations, the linkage can be disconnected to enable mechanical intervention for mechanically shifting the flow control valve.

The flow control valve can be mounted along a well tubing. The flow control valve can have a flow area equivalent to an internal cross-sectional area of the well tubing.

In some embodiments, a method of operating a flow control valve includes powering up a pump system configured to pump hydraulic control fluid from a reservoir; activating a selected solenoid operated valve (SOV) in a manifold comprising hydraulic circuitry linking the pump system with an electro-hydraulic actuator mounted externally to the flow control valve; flowing hydraulic control fluid from the reservoir, through the manifold, and into a chamber of the actuator such that a piston of the actuator moves in an open or a close direction; and moving a piston of the flow control valve by movement of the piston of the actuator.

The SOV can be a 3-way, 2-position, normally closed valve. The SOV can be a 2-way, 2-position, normally open valve. The SOV can act as a directional switch.

The method can further include performing mechanical intervention on the actuator by using a shifting tool to mechanically move the piston of the actuator.

In some embodiments, a flow control valve includes a housing; a piston movably disposed within the housing to adjust flow through the flow control valve; at least one groove formed in an outer surface of the housing, the at least one groove housing an electrically powered actuator; and a linkage coupling the actuator to the piston such that movement of the actuator causes movement of the piston.

The at least one groove can include a first groove housing the actuator and a second groove housing electronics. The actuator can be an electro-hydraulic actuator. The electro-hydraulic actuator can include an internal piston. In use, movement of the internal piston of the actuator causes movement of the piston of the flow control valve to adjust flow through the flow control valve.

However, many modifications are possible without materially departing from the teachings of this disclosure. Accordingly, such modifications are intended to be included within the scope of this disclosure as defined in the claims.

BRIEF DESCRIPTION OF THE FIGURES

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
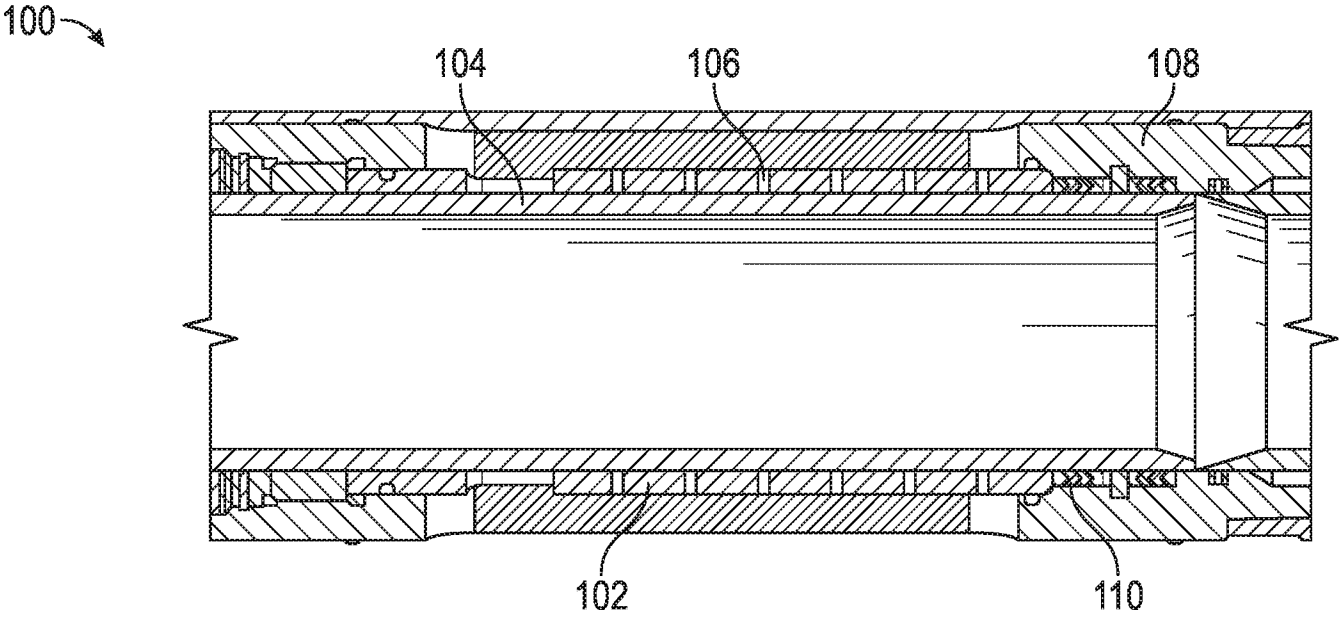
FIG. 1 is a cross-sectional illustration of an example of a flow control valve having a housing, a piston, a choke, and choke seals, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology to facilitate flow control downhole. According to embodiments, the system and methodology provide mechanical architectural elements for the design of an electrically powered downhole flow control valve (FCV). A solid gauge mandrel type design for a FCV may restrict the maximum allowable production flow rate through the valve. In contrast, FCVs according to the present disclosure can have a flow area that may be equivalent to the tubing internal cross section.

Various embodiments described herein cover options for integrating an Electro-Mechanical Actuator (EMA), mounted externally to the valve, and connecting it to the FCV internal piston. This permits use of a traditional FCV choke design with an internal piston, a hard erosion resistant sleeve for the flow openings, and existing choke sealing elements. Embodiments also cover the implementation of an Electro-Hydraulic Actuator (EHA) in lieu of the EMA. As the available power source for the actuator is electrical, the EHA also may include a hydraulic fluid reservoir and an electrically powered pump to provide the pressurized hydraulic fluid. In addition, the present disclosure provides several options for controlling the position of FCV while actuated with the EHA or EMA. Various embodiments described herein relate to the linkage between the actuator and the FCV internal piston, in the case of an EMA drive. The linkage system may include options for a disconnect ability in case it is desired to mechanically intervene and operate the valve through slickline or other mechanical intervention methods.

In subsea fields, hydraulic flow control valves utilize the infrastructure on the seabed to handle and distribute pressurized hydraulic fluid to each well head and each hydraulic control line. In conventional systems, this functionality represents a substantial cost and complexity for the subsea infrastructure, the umbilical, and the surface platform or FPSO. Removing the need to handle pressurized hydraulic fluid can lead to substantial reduction in cost of the subsea infrastructure.

A fully electric downhole flow control system helps overcome both of these limitations especially when other (traditionally hydraulically operated) equipment in the well is converted to full electric as well (e.g. the safety valve). A high number of electrically powered flow control devices can be connected on a single electrical cable, thus using just one penetrator at the wellhead. Electrical power it is used to operate such a completion system, simplifying greatly the system on the seabed and potentially also simplifying the umbilical to the production facility.

A valve providing a flow area equivalent to the tubing inner cross-sectional area is referred to as a "Full Bore" valve. Traditional hydraulic full bore valves have an internal piston to control the amount of opening and flow through a choke. Given the size of the piston, sealing systems and bearings around the piston, substantial loads may be used to operate such a valve by overcoming the amount of friction generated by the dynamic and choke seals. Hydraulically operated valves can easily provide the desired load via a high hydraulic supply pressure and a large piston area. Converting such valves to an electric drive poses some challenges as the load provided by an electromechanical actuator is usually lower than what can be delivered by traditional hydraulic FCVs.

One way to address this challenge is to implement the electric drive on a smaller valve, such as a side-pocket mandrel valve. In such an arrangement, the choke, piston and sealing systems are much smaller and utilize substantially less force, at the expense of a reduced flow area and limited maximum allowable flow rate through the valve. For applications involving high flow rates, the challenge is to find a suitable way of integrating an electrically powered actuator mechanism able to deliver sufficient force to operate a full bore valve.

Referring initially to FIG. 1, embodiments described herein cover architectural choices for designing an electrically powered FCV. Designs according to the present disclosure advantageously use the configuration of traditional FCVs including an internal piston, but also maximize the flow area and are operated electrically. Use of the configuration of traditional FCVs allows for minimizing development effort and takes advantage of a robust choke design already developed for hydraulic full bore FCVs.

Full bore FCVs may rely on an internal piston moving back and forth, e.g. up or down, to open or close hydraulic flow ports which selectively places the annulus and the tubing in fluid communication. While the upper section of the FCV is dedicated to the actuation and position indexing mechanism, the choking (or flow control) and sealing functions of the valve are done at the choke section. As shown in FIG. 1, the choke 100 may include a sleeve 102, which can be made of or include a hard material for erosion resistance, and an inner piston 104, which in operation closes and/or opens ports 106 of the sleeve 102. The piston 104 and sleeve 102 are disposed in a choke housing 108. The choke also includes a seal stack 110 sealing off the valve when the piston 104 is in the closed position.

Figure 2:
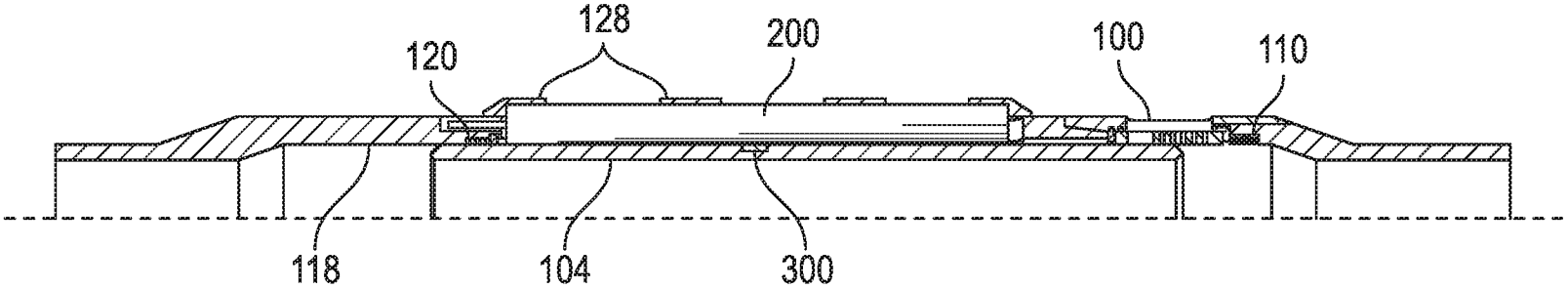
FIG. 2 is an illustration of a flow control valve architecture with an actuator implanted in a main housing, according to an embodiment of the disclosure.

In FCVs according to the present disclosure, a section, for example, an upper section when deployed in a horizontal portion of a well, of the flow control valve may be modified to house an electrical actuator 200, for example as shown in FIG. 2. As described herein, the actuator 200 can be an electro-mechanical actuator (EMA) or an electro-hydraulic actuator (EHA). In some configurations, the electrical actuator 200 is housed in a groove cut throughout the FCV main housing 118, for example, along and/or in an outer surface of the FCV main housing 118. The internal piston 104 of the valve is able to hold the pressure when the valve is closed due to, for example, two sealing elements in the form of the choke seal(s) or seal stack 110 in the choke housing 108 and a dynamic seal 120 at the top of the main housing 118. Such implementation allows an externally mounted actuator 200 to connect to the valve internal piston 104 via a linkage mechanism 300, while at the same time being housed and protected by the main housing 118 itself, as illustrated in FIG. 2. The actuator 200 may be maintained in place by additional clamps and/or protectors 128 as illustrated. The electronics controlling the actuator 200 and/or electronics for telemetry with the surface control panel can be placed in parallel in separate groove(s) in the FCV housing 118 to reduce the overall length of the system.

Figure 3:
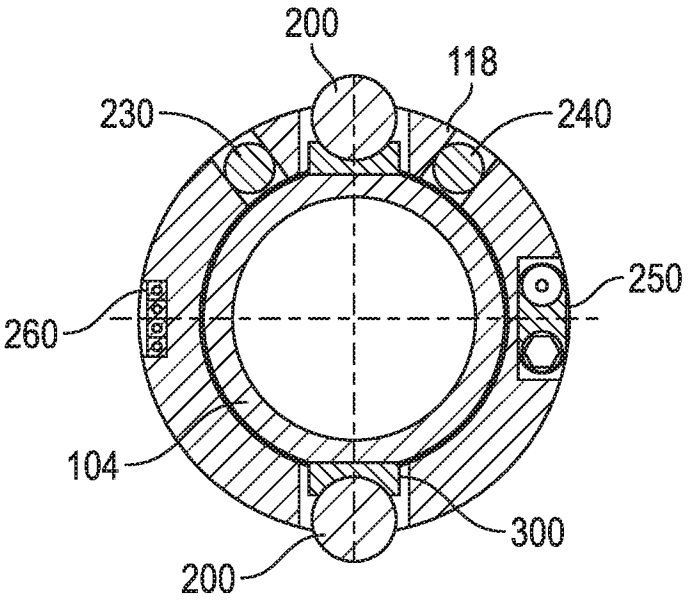
FIG. 3 is a cross-sectional view of a flow control valve showing a housing containing actuators, electronics, and sensors, according to an embodiment of the disclosure.

As further illustrated in FIG. 3, this configuration also advantageously allows multiple actuators 200 to be assembled onto the FCV. This could be particularly advantageous for electro hydraulic actuator (EHA) solutions, as described below, in which one assembly including a motor, a pump, and a distribution manifold distributes pressurized hydraulic fluid to multiple actuators 200, thus increasing the actuation load. In some configurations, multiple EMAs can be connected to a single piston 104.

Figure 4:
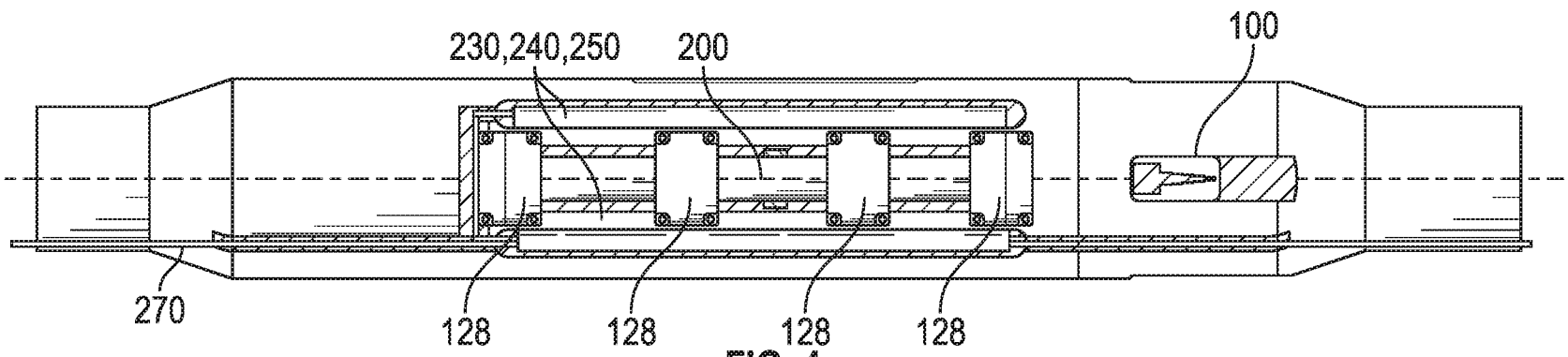
FIG. 4 is an illustration of an example of a flow control valve with electronics and sensors located in grooves of a main housing, according to an embodiment of the disclosure.

As described, FIG. 3 illustrates the integration of various elements, including multiple actuators 200 and various electronics, in the FCV main housing 118, each in a separate groove. This schematic shows the housing 118 containing two actuators 200, electronics 230 for controlling one or both of the actuators 200, and electronics and/or sensors 240 (e.g., for telemetry with the surface and/or position sensing). As shown, the housing 118 can also house one or more sensors 250 (such as position, pressure, temperature, and/or other sensors or gauges) and/or one or more bypass lines 260. The FCV main housing 118 is able to resist tensile and compressive loads as the piston 104 alone takes the differential pressure across the valve when closed. This enables machining of the housing 118 to host other sensors as well, such as pressure and temperature sensors 250, as also illustrated in FIG. 4. The FCV housing 118 can therefore replace a traditional gauge carrier mandrel, reducing the overall length of intelligent completion smart assemblies (including a FCV and one or more sensors or gauges).

In various embodiments, the electrically powered actuator 200 driving the FCV can be an electro mechanical actuator (EMA), which receives electrical power as input, e.g., from one or more electrical cables 270 as shown in FIG. 4, and converts the electrical power into a translating movement. The EMA includes, for example, an electric motor 202, a gear box or reducer 204, a screw 206 (e.g., a ball screw or roller screw), and one or more bearings 208, as shown in the example configuration of FIG. 5. These internal components or elements operate to convert the electrical power to translational movement. These elements may be immersed in a dielectric fluid providing electrical insulation and lubrication. This oil may be pressure compensated with the external environment by a bellow.

Figure 5:
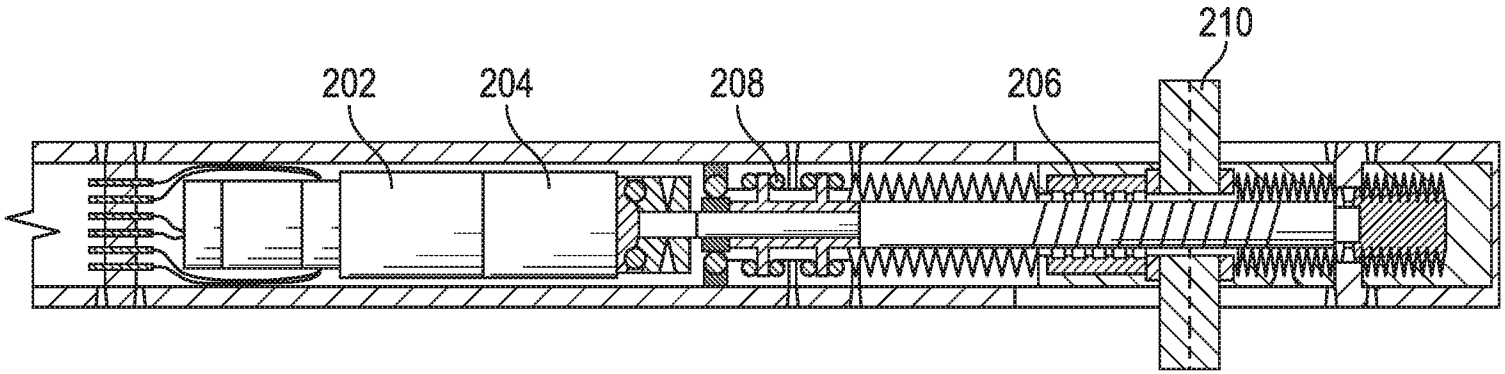
FIG. 5 is an illustration of an example of an electro-mechanical actuator for use with a flow control valve, according to an embodiment of the disclosure.
Figure 6:
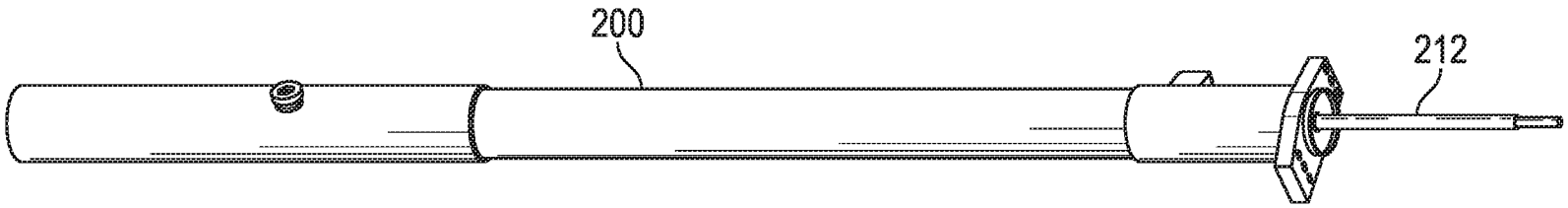
FIG. 6 is an illustration of an in-line translating axle which may be used with the electro-mechanical actuator of FIG. 5, according to an embodiment of the disclosure.

Referring generally to FIG. 5, an example of an EMA is illustrated as providing two output pins 210 on the side of the actuator 200 that can be connected to the FCV piston 104 by a linkage mechanism 300. In another embodiment illustrated in FIG. 6, the translational movement is output in line with the actuator. FIG. 6 show an EMA with an in-line translating axle 212.

Another option for driving the FCV piston 104 is an electro-hydraulic actuator (EHA) (for example, as shown in the example embodiment of FIG. 7) coupled with a pump system and a reservoir of fluid. As shown, the EHA includes a piston 280 disposed in a housing 218 such that a first hydraulic chamber 282 is created between one end of the piston 280 and an inner surface of the housing 218 and a second hydraulic chamber 284 is created between the opposite end of the piston 280 and the inner surface of the housing 218. The piston 280 therefore isolates and seals the hydraulic chambers 282, 284 from each other. A first hydraulic port 283 extends through the housing 218 to the first chamber 282, and a second hydraulic port 285 extends through the housing 218 to the second chamber 284. In use, hydraulic fluid is pumped from the reservoir through the first and/or second port 283, 285 to the respective chamber 282, 284. The piston 280 is connected to the piston 104 of the FCV via the linkage 300. A piston seal 286 is disposed about the piston 280 proximate to each end of the piston 280.

In use, the pump provides pressurized hydraulic fluid to operate the EHA. A manifold can distribute the pressurized hydraulic fluid to one or the other hydraulic chamber 282, 284 of the actuator. One chamber is used to push the FCV to an open position, the other one to push the FCV to a close position. In other words, flow of hydraulic fluid from the reservoir, through one of the ports 283, 285 into one of the hydraulic chambers 282, 284 moves the piston 280 in a direction that thereby moves the piston 104 of the FCV in a direction that opens the FCV, and flow of hydraulic fluid from the reservoir, through the other port 283, 285 into the other hydraulic chamber 282, 284 moves the piston 280 in the opposite direction, thereby moving the piston 104 of the FCV in the opposite direction to close the FCV.

Figure 7:
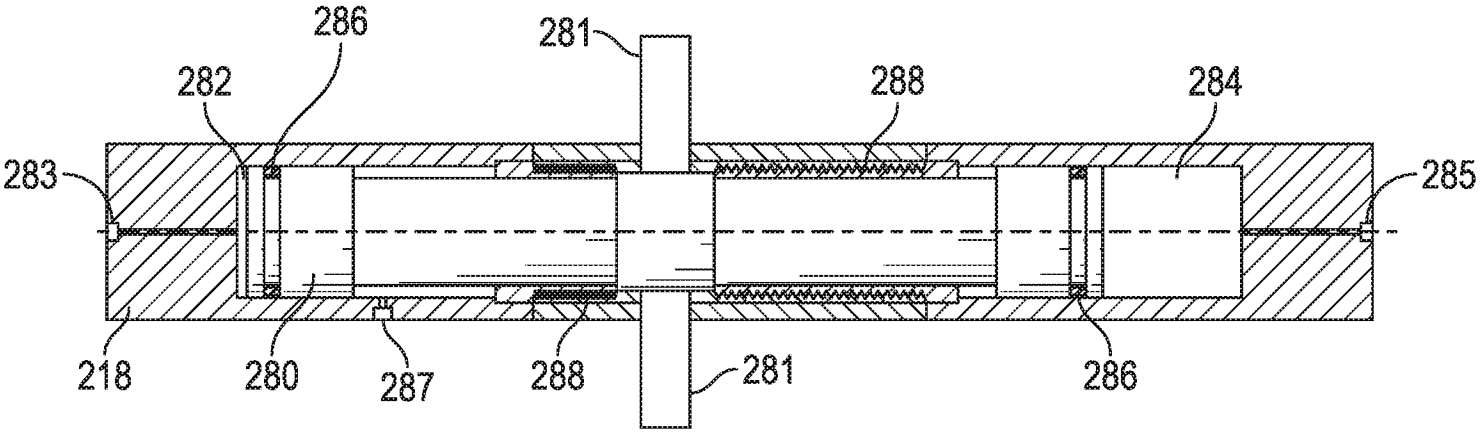
FIG. 7 is an illustration of an example of an electro-hydraulic actuator for use with a flow control valve, according to an embodiment of the disclosure.

As shown in FIG. 7, the piston 280 can be equipped with two connecting rods 281, which are used for the connection to the FCV piston 104. Alternatively, the connecting rods 281 can be connected to or anchor in the FCV main housing 118 with the hydraulic actuator 200 coupled to the FCV piston 104. In this implementation, clean hydraulic oil is present on both sides of the hydraulic piston seals 286 to avoid loss of hydraulic fluid (or ingress of well fluids) through leaks around the dynamic seals. A series of bellows 288 isolate the clean hydraulic fluid from the well fluids while permitting movement of the piston 280. The fluid internal to the bellows 288 is at the same pressure as the annulus, as the bellows 288 may not tolerate a substantial differential pressure. This oil volume is connected to the oil reservoir of the pump system (see hydraulic schematics discussed in greater detail below) through a third port 287.

Figure 8:
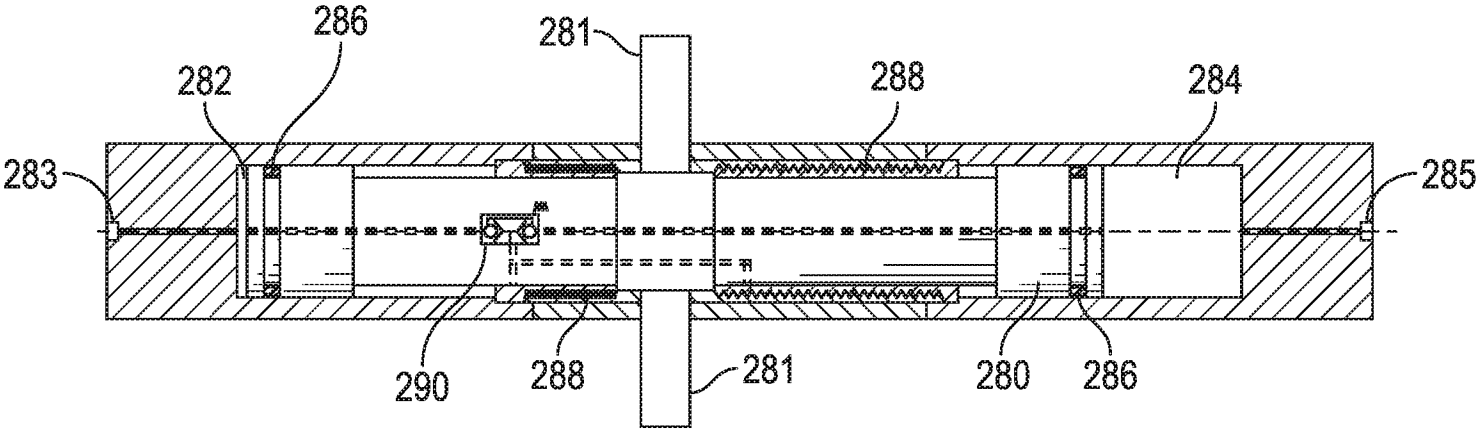
FIG. 8 is an illustration of another example of an electro-hydraulic actuator for use with a flow control valve, according to an embodiment of the disclosure.

In some configurations, to reduce the number of ports and/or ensure the oil volume internal to the bellows 288 is always connected to the lowest pressure of both hydraulic chambers 282, 284, the third port 287 may be replaced by an inverse shuttle valve 290, as illustrated in FIG. 8. The inverse shuttle valve 290 acts as a logical hydraulic function, putting the exit port (third port 287) in communication with the lowest pressure port between the chambers 282, 284.

For the configurations illustrated in FIGS. 7 and 8, a pump system 350 equipped with or coupled to a manifold (as shown in FIGS. 9-14 and described herein) is used to supply pressurized hydraulic fluid to one side or the other of the EHA piston (i.e., to the first chamber 282 or the second chamber 284). The pump system 350 includes a motor and a pump. The manifold includes hydraulic circuitry linking the pump system 350 (e.g., the pump) with the actuator 200. According to some embodiments, the pump system may rely solely on electric power. Examples include an electric motor coupled to a gear box and a hydraulic pump such as a piston or swashplate pump. The manifold also may include a compensating system 360 (shown in FIGS. 9-14) to equalize the oil reservoir pressure with the annulus pressure. This compensating system can be a piston or a bellow as this can ensure a fully sealed system.

Referring generally to FIGS. 9-14, three examples of manifolds, or hydraulic circuitry, are presented which use solenoid operated valves (SOVs) and other micro hydraulic components. The first example, illustrated in FIGS. 9-10, comprises a circuit with two 3-way, 2-position normally closed solenoid operated valves. The second example, illustrated in FIGS. 11-12, comprises a circuit with two 2-way, 2-position normally open solenoid operated valves. The third example, illustrated in FIGS. 13-14, comprises a circuit with a single 3-way directional solenoid operated valve.

Figure 9:
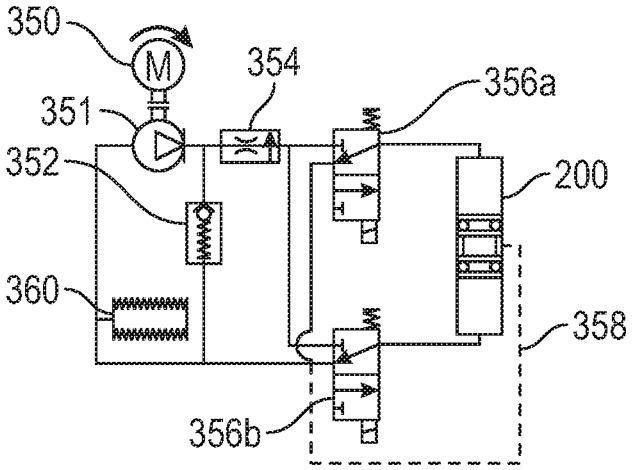
FIG. 9 is a schematic illustration of an example of an electro-hydraulic actuator and associated hydraulic circuitry for use with a flow control valve, according to an embodiment of the disclosure.

In the first example manifold implementation illustrated in FIG. 9, the pump system 350, including a motor and a pump, provides pressurized fluid from the reservoir 351. A relief valve 352 protects the hydraulic components from over pressure. Excess pressure cracks the relief valve 352 open and lets fluid return straight to the reservoir. The illustrated configuration includes an optional flow regulator 354, which can be used to evaluate the displacement of the hydraulic actuator 200 using a time base. The flow regulator 354 outputs a constant flow rate, regardless of the differential pressure across it. This allows for controlling the movement of the EHA by relying on the actuation duration. If the position measurement is realized with a position sensor, the flow regulator 354 is not necessary and can be removed. Two normally closed (as shown in FIG. 9) solenoid operated valves (SOVs) 356*a*, 356*b* drive the EHA in one or the other direction. A compensation line 358 is represented in dotted line from the EHA to take into account the oil volume protected by the bellow(s) 288 (see third port 287 in FIG. 7).

Figure 10A:
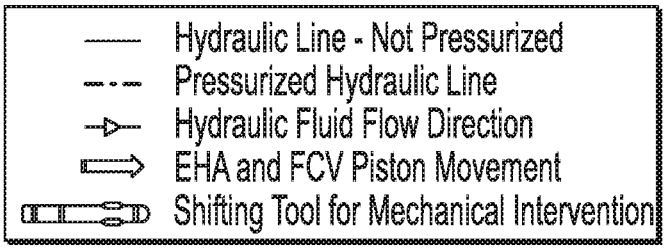
FIGS. 10A-10D are schematic illustrations of examples of the electro-hydraulic actuator and associated hydraulic circuitry as illustrated in FIG. 9 in various operational modes, according to an embodiment of the disclosure.
Figure 10A:
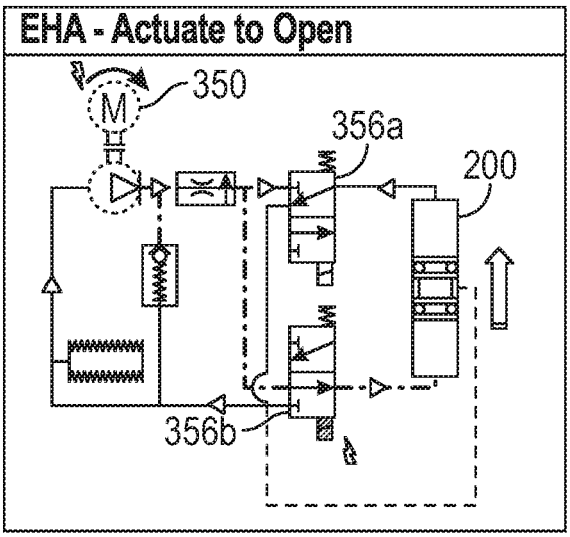
Figure 10B:
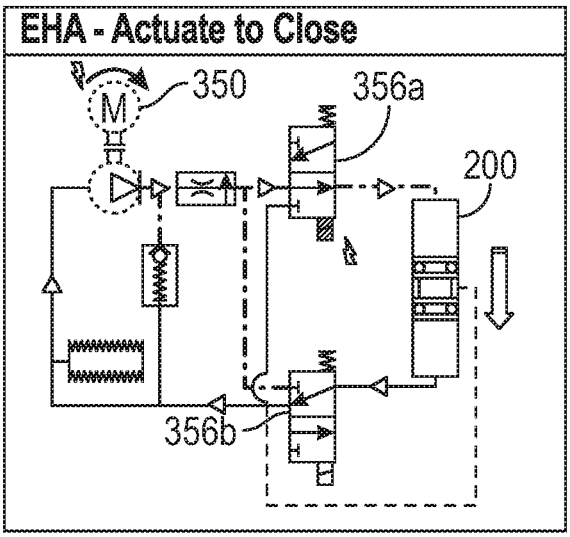

FIGS. 10A-10B illustrate four modes of operation for the manifold embodiment of FIG. 9. Specifically, FIG. 10A illustrates actuation of the EHA in an open direction (e.g., moving the EHA piston 280 upwards). The pump system 350 is on or powered up and pumps hydraulic fluid from the reservoir through the manifold. As shown, SOV 356*a* is closed, but SOV 356*b* is activated to open, so that hydraulic fluid flows through SOV 356*b* to the bottom chamber (in the orientation of FIG. 10A) of the EHA 200, thereby moving the EHA piston 280 upward. As described herein, the actuator 200 is coupled to the FCV piston 104 via a linkage 300, such that movement of the EHA piston 280 thereby causes corresponding movement of the FCV piston 104. FIG. 10B illustrates actuation of the EHA in a close direction (e.g., moving the EHA piston 280 downwards). The pump system 350 is on or powered up, SOV 356*b* is closed, and SOV 356*a* is activated to open, so that hydraulic fluid flows through SOV 356*a* to the top chamber (in the orientation of FIG. 10B) of the EHA 200, thereby moving the EHA piston 280 downward.

Figure 10C:
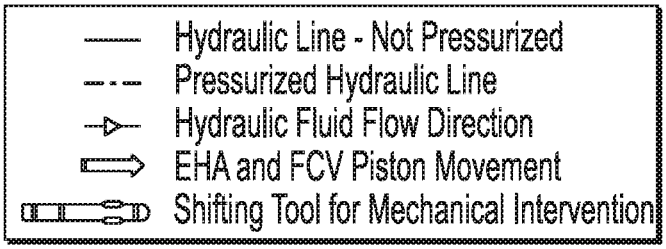
Figure 10C:
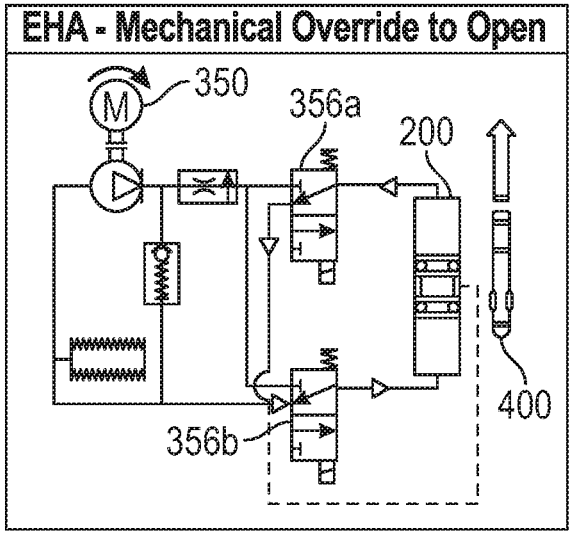
Figure 10D:
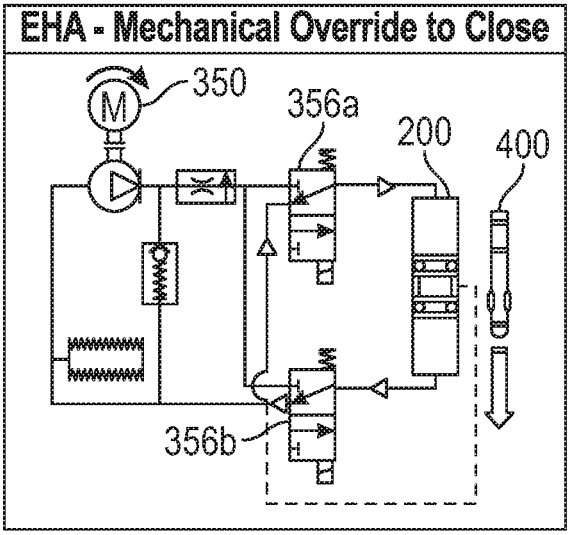

FIGS. 10C and 10D illustrate mechanical intervention modes. As shown, a shifting tool 400 can be used for mechanical intervention. FIG. 10C illustrates mechanical intervention or override to open the FCV (e.g., moving the piston 280 upwards via upward movement of the shifting tool 400). FIG. 10D illustrates mechanical intervention or override to close the FCV (e.g., moving the piston 280 downwards via downward movement of the shifting tool 400). In both mechanical intervention modes, the pump system 350 is off or powered down, and both SOVs 356*a*, 356*b* are closed. Mechanical movement of the piston 280 by the shifting tool 400 forces circulation of hydraulic fluid through the SOVs 356*a*, 356*b* from one chamber of the EHA to the other.

An example of an FCV actuation sequence or method includes the steps of: 1. Power up motor of the pump system 350 such that the pump generates pressure in the hydraulic circuitry up to a max of $P_r$ (cracking pressure of the relief valve); 2. Activate the desired SOV 356*a*, 356*b* so the EHA 200 starts moving; 3. De-activate the activated SOV to stop the EHA 200 movement; and 4. Stop the motor and pump (or pump system 350). This circuitry is compatible with mechanical intervention as both EHA hydraulic chambers 282, 284 are in direct communication when the SOVs 356*a*, 356*b* are not activated, thus allowing EHA piston 280 movement without hydraulic lock.

Figure 11:
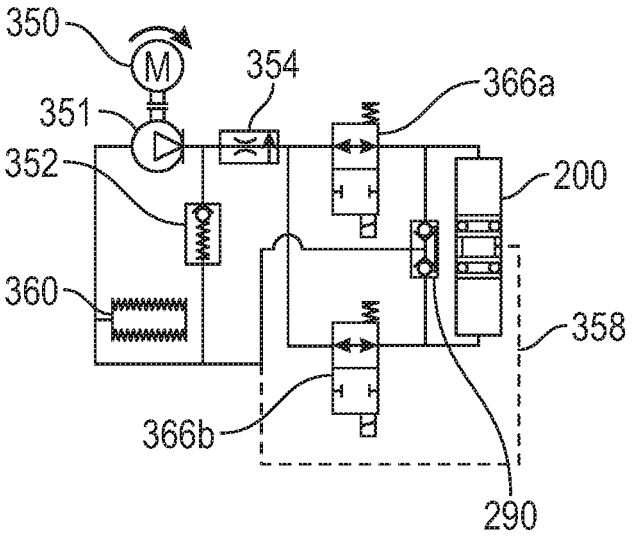
FIG. 11 is a schematic illustration of another example of an electro-hydraulic actuator and associated hydraulic circuitry for use with a flow control valve, according to an embodiment of the disclosure.

In the second example manifold implementation illustrated in FIG. 11, the hydraulic circuitry is a slight variation of the circuitry illustrated in FIG. 9. Instead of 3-way, 2-position, normally closed SOVs (as included in the manifold of FIGS. 9-10), the manifold of FIG. 11 includes 2-way, 2-position, normally open (as shown in FIG. 11) SOVs 366*a*, 366*b*, plus the addition of an inverse shuttle valve 290 for releasing the low pressure side of the EHA hydraulic piston 280 to the reservoir and pressure compensator or compensation bellow 360. The circuitry is compatible with mechanical intervention as both sides of the EHA piston 280 are in communication when the SOVs 366*a*, 366*b* are not actuated. This embodiment utilizes one additional hydraulic component (inverse shuttle valve 290) but has the advantage of using simpler and potentially more reliable SOVs 366*a*, 366*b*.

Figure 12A:
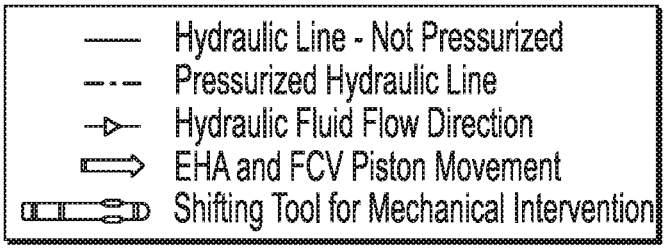
FIGS. 12A-12D are schematic illustrations of examples of the electro-hydraulic actuator and associated hydraulic circuitry as illustrated in FIG. 11 in various operational modes, according to an embodiment of the disclosure.
Figure 12A:
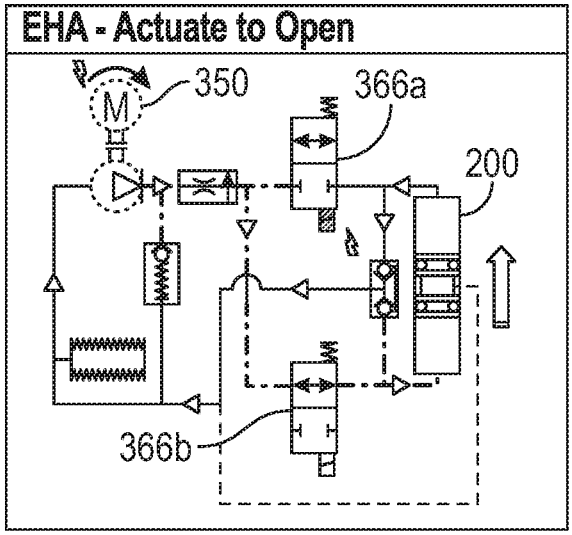
Figure 12B:
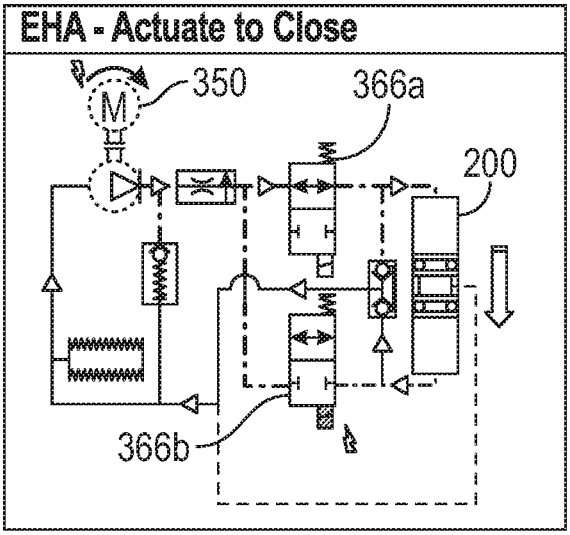

FIGS. 12A-12D illustrate four modes of operation for the manifold of FIG. 11. FIG. 12A illustrates actuation of the EHA piston 280 in an open direction (e.g., moving the EHA piston 280 upwards). The pump system 350 is on or powered up and pumps hydraulic fluid from the reservoir through the manifold. As shown, SOV 366*b* is in its default open position, but SOV 366*a* is activated to close, so that hydraulic fluid flows through SOV 366*b* to the bottom chamber (in the orientation of FIG. 12A) of the EHA 200, thereby moving the EHA piston 280 upward. As described herein, the actuator 200 is coupled to the FCV piston 104 via a linkage 300, such that movement of the EHA piston 280 thereby causes corresponding movement of the FCV piston 104. FIG. 12B illustrates actuation of the EHA 200 in a close direction (e.g., moving the EHA piston 280 downwards). The pump system 350 is on or powered up, SOV 366*a* is in its default open position, and SOV 366*b* is activated to close, so that hydraulic fluid flows through SOV 366*a* to the top chamber (in the orientation of FIG. 12B) of the EHA 200, thereby moving the EHA piston 280 downward.

Figure 12C:
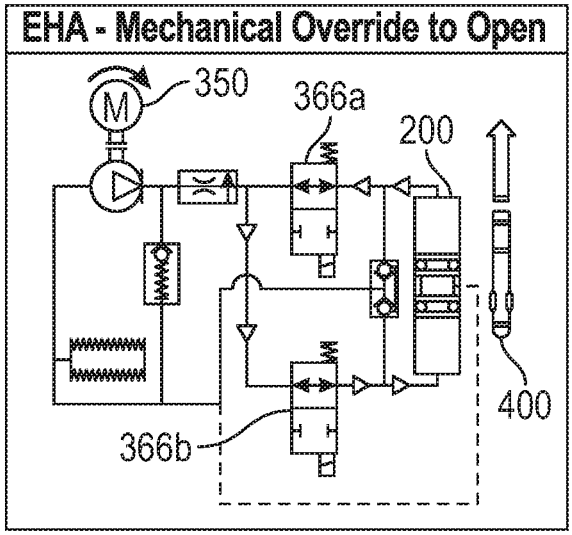
Figure 12D:
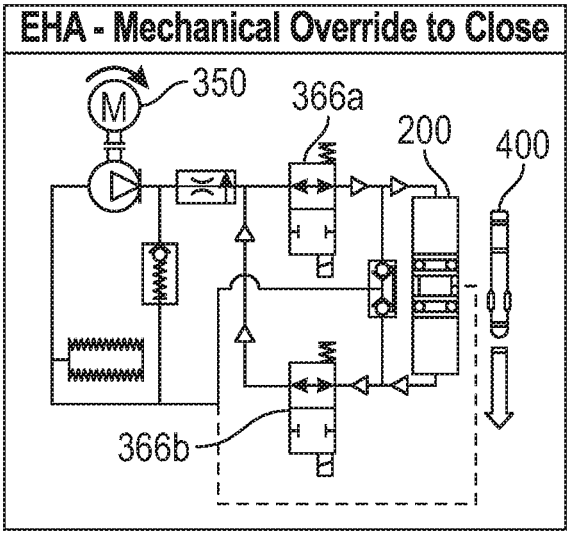

FIGS. 12C and 12D illustrate mechanical intervention modes. As shown, shifting tool 400 can be used for mechanical intervention. FIG. 12C illustrates mechanical intervention or override to open the FCV (e.g., moving the piston 280 upwards via upward movement of the shifting tool 400). FIG. 12D illustrates mechanical intervention or override to close the FCV (e.g., moving the piston 280 downwards via downward movement of the shifting tool 400). In both mechanical intervention modes, the pump system 350 is off or powered down, and both SOVs 366*a*, 366*b* are open. Mechanical movement of the piston 280 by the shifting tool 400 forces circulation of hydraulic fluid through the SOVs 366*a*, 366*b* from one chamber of the EHA to the other.

An example of an FCV actuation sequence or method of the embodiment of FIGS. 11-12 includes the steps of: 1. Activate the desired SOV 366*a*, 366*b* first. At this stage there is no EHA 200 movement as there is no pressure in the system; 2. Power up motor of the pump system 350 such that the pump generates pressure that starts actuating the EHA 200 and associated FCV piston 104; 3. Stop the motor and pump such that the EHA 200 stops, as well as the associated FCV piston 104; and 4. De-activate the SOV.

Figure 13:
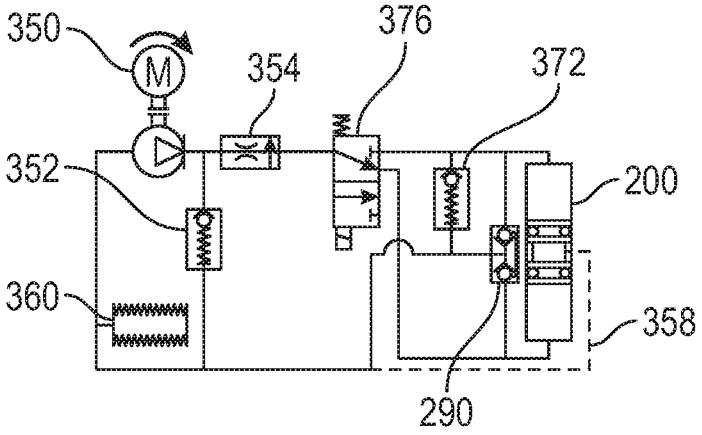
FIG. 13 is a schematic illustration of another example of an electro-hydraulic actuator and associated hydraulic circuitry for use with a flow control valve, according to an embodiment of the disclosure.

In the third example manifold implementation illustrated in FIG. 13, hydraulic circuitry is illustrated which uses a single SOV 376 as a directional switch. If the SOV 376 is not energized, the system will move the EHA 200 towards the open position as soon as the pump system 350 is activated. To actuate the EHA 200 in the other (close) direction, the SOV 376 is energized. The implementation illustrated in FIG. 13 can be reversed such that movement of the EHA 200 is to close when the SOV 376 is not activated.

To be compatible with mechanical intervention, an additional relief valve 372 is used as illustrated in FIGS. 13-14. To mechanically operate the FCV with a shifting tool 400, the operator applies an amount of force that will create pressure in the hydraulic system high enough to crack open the relief valves 352, 372. The relief valves 352, 372 and the EHA piston 280 area can be sized such that the effort to operate the valve mechanically is compatible with the different shifting method used (e.g., slickline, or tractor). For reference, the Schlumberger tractor ReSOLVE® can apply up to 40,000 lbfs linearly. This should far exceed the load desired for operating the FCV piston 104 manually.

Figure 14A:
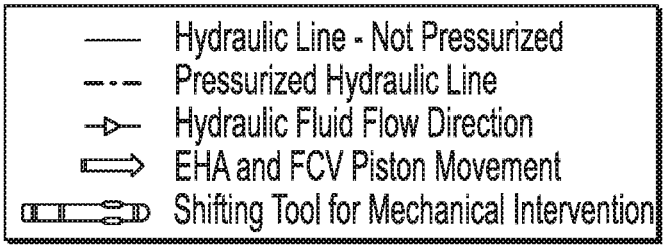
FIGS. 14A-14D are schematic illustrations of examples of the electro-hydraulic actuator and associated hydraulic circuitry as illustrated in FIG. 13 in various operational modes, according to an embodiment of the disclosure.
Figure 14A:
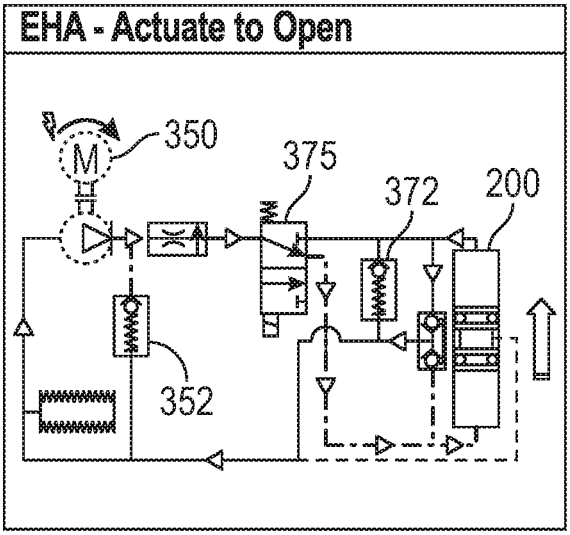
Figure 14B:
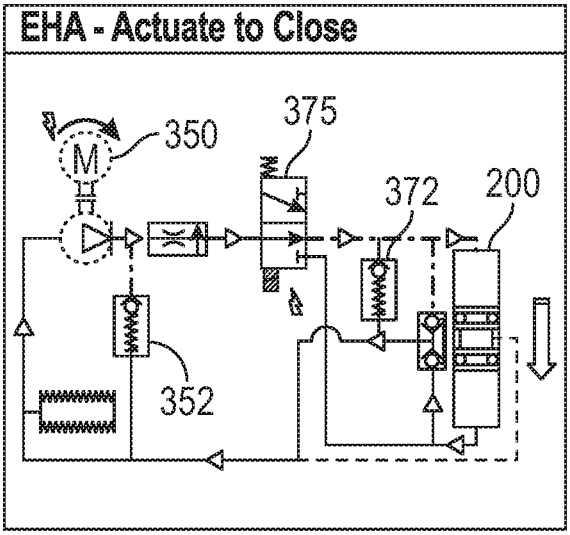

FIGS. 14A-14D illustrate four modes of operation for the manifold of FIG. 13. FIG. 14A illustrates actuation of the EHA piston 280 in an open direction (e.g., moving the EHA piston 280 upwards). The pump system 350 is on or powered up and pumps hydraulic fluid from the reservoir through the manifold. As shown, SOV 376 is in its default position so that hydraulic fluid flows through SOV 376 to the bottom chamber (in the orientation of FIG. 14A) of the EHA 200, thereby moving the EHA piston 280 upward. As described herein, the actuator 200 is coupled to the FCV piston 104 via a linkage 300, such that movement of the EHA piston 280 thereby causes corresponding movement of the FCV piston 104. FIG. 14B illustrates actuation of the EHA 200 in a close direction (e.g., moving the EHA piston 280 downwards). The pump system 350 is on or powered up, SOV 376 is activated, so that hydraulic fluid flows through SOV 376 to the top chamber (in the orientation of FIG. 14B) of the EHA 200, thereby moving the EHA piston 280 downward.

Figure 14C:
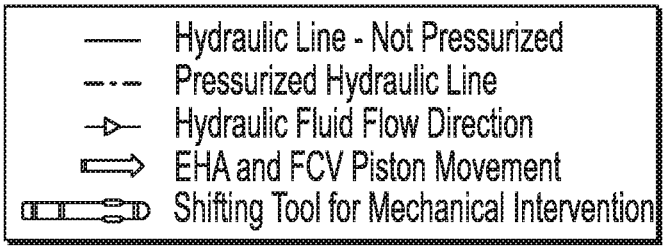
Figure 14C:
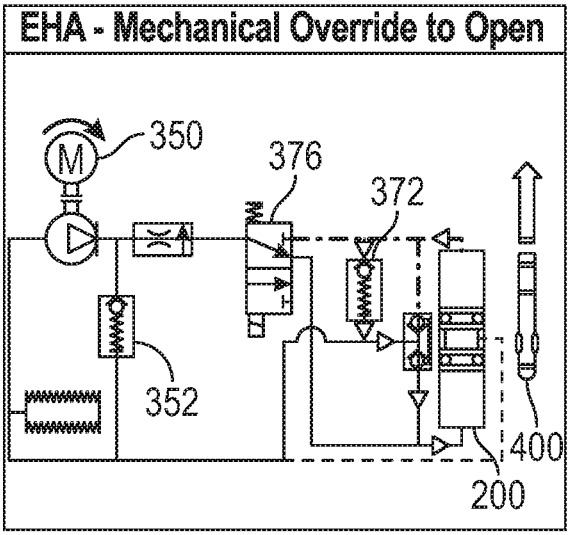
Figure 14D:
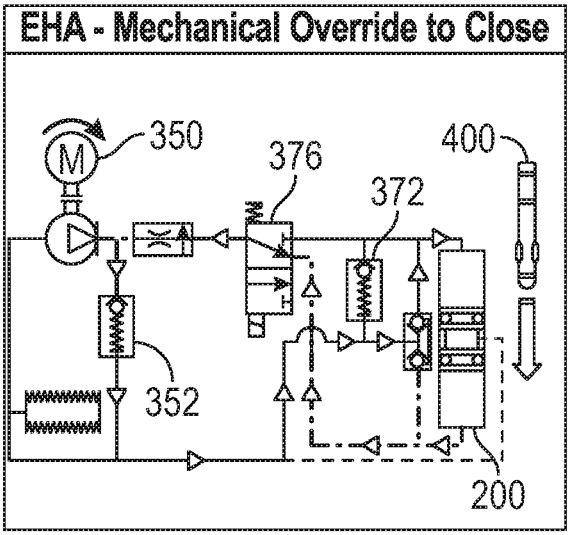

FIGS. 14C and 14D illustrate mechanical intervention modes. As shown, shifting tool 400 can be used for mechanical intervention. FIG. 14C illustrates mechanical intervention or override to open the FCV (e.g., moving the piston 280 upwards via upward movement of the shifting tool 400). FIG. 14D illustrates mechanical intervention or override to close the FCV (e.g., moving the piston 280 downwards via downward movement of the shifting tool 400). In both mechanical intervention modes, the pump system 350 is off or powered down, and the SOV 376 is in its default state. As described, the operator applies sufficient force to the shifting tool 400 to create pressure in the manifold high enough to open the relief valves 352, 372 such that hydraulic fluid flows through the circuit from one chamber of the EHA to the other.

An example of an FCV actuation sequence or method for opening the valve of the embodiment of FIGS. 13-14 includes the steps of: 1. Power up motor of the pump system 350 such that the pump generates pressure that starts actuating the EHA 200 and associated FCV piston 104 towards the open direction; 2. Stop the motor and pump; the EHA 200 stops as well as the associated FCV piston. An example of an FCV actuation sequence or method for closing the valve includes the steps of: 1. Activate the SOV 376 first. At this stage, no EHA movement has occurred as there is no pressure in the system; 2. Power up motor of the pump system 350 such that the pump generates pressure that starts actuating the EHA and associated FCV piston towards the closed position; 3. Stop the motor and pump; the EHA stops as well as the associated FCV piston; and 4. De-activate the SOV 376.

With respect to position measurement, the measurement of the displacement of the piston can be done multiple ways. A first method is by direct measurement of the FCV piston 104 position via a position sensor (e.g. LVDT, resistive, AMR, acoustic, or other appropriate sensor). The position sensor, e.g., sensor 240, can be located in its own groove in the FCV main housing 118 in parallel to the actuator 200 and other electronics 230, as shown in FIG. 3.

Other methods of position measurement also may be employed, such as providing measurement components inside the actuator 200. Examples include: 1. A resolver counting motor turns in the EMA can provide displacement information of the mechanical actuator. This can translate directly to the FCV piston 104 position once the position measurement is calibrated (record the full close position for instance). 2. Time-based actuation for the electro hydraulic actuator: each of the three illustrated hydraulic circuit embodiments includes a flow regulator 354 that outputs a constant flowrate regardless of the differential pressure across it. With the information of the hydraulic fluid rate flowing to the EHA piston chamber it is straightforward to determine the displacement of the actuator as a function of the actuation duration. Once the system is calibrated, the actual FCV position can be computed easily.

Depending on the embodiment, various types of linkages 300 may be used between the FCV piston 104 and the electrically powered actuator 200. For example, with an electro hydraulic actuator 200, the linkage 300 between the FCV piston 104 and the actuator 200 itself can be a straight anchoring. This will provide a simple technical solution for transmitting the load and displacement from the actuator 200 to the piston 104.

As the hydraulic circuitry embodiments described herein are compatible with mechanical intervention, the FCV piston 104 can be operated with a shifting tool 400 while still connected to the actuator 200. The actuator 200 will not create hydraulic lock which could otherwise prevent the mechanical override of the FCV. The embodiment of hydraulic circuitry shown in FIGS. 13-14 (single SOV 376 design) may utilize extra force to shift the piston due to cracking pressure of the relief valves 352, 372.

When the FCV is equipped with an electro mechanical actuator 200, there may be a desire to unlatch the actuator 200 from the piston 104. Unlatching permits overriding mechanically the valve position without damaging the actuator 200 in case the drive screw is not reversible (i.e. the assembly of the screw, gearbox, and motor will not rotate back regardless of the load applied on the actuator axles). In this particular case, the linkage mechanism 300 should include a releasable latching system such as a collet or a disengaging system. Examples of two embodiments include: 1. A shear system. A piece in the linkage 300 will break at a controlled load exceeding the nominal operating load of the actuator 200, thus releasing the piston 104 from the actuator 200. An example of such shear system is the shear pin used in packers, breaking at a specified effort; and 2. An elastic latch system that will disengage once the axial load exceeds the latching force. The latch can be re-engaged later by moving the piston manually or operating the actuator if its function is not lost.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a flow control valve having an internal piston; and an electrically powered actuator mounted externally to the flow control valve and connected to the internal piston via a linkage, the electrically powered actuator responding to electrical inputs to shift the internal piston to desired flow positions;

wherein the flow control valve comprises a housing, the internal piston moveably disposed within the housing, and an outer surface of the housing comprises one or more grooves formed therein.

2. The system as recited in claim 1, wherein the actuator is held in place along the outer surface of the housing of the flow control valve with one or more clamps or protectors.

3. The system as recited in claim 1, wherein the actuator is disposed in the one or more grooves formed in the outer surface of the housing of the flow control valve.

4. The system as recited in claim 1, wherein the one or more grooves comprises a first groove housing the actuator and a second groove housing electronics and/or one or more sensors.

5. The system as recited in claim 1, wherein the electrically powered actuator comprises an electro-mechanical actuator (EMA).

6. The system as recited in claim 1, wherein the flow control valve is mounted along a well tubing, the flow control valve having a flow area equivalent to an internal cross-sectional area of the well tubing.

7. The system as recited in claim 1, wherein the linkage is configurable to disconnect to enable mechanical intervention for mechanically shifting the flow control valve.

8. A system for use in a well, comprising:

a flow control valve having an internal piston; and an electrically powered actuator mounted externally to the flow control valve and connected to the internal piston via a linkage, the electrically powered actuator responding to electrical inputs to shift the internal piston to desired flow positions;

wherein the electrically powered actuator comprises an electro-hydraulic actuator (EHA).

9. The system as recited in claim 8, further comprising a manifold and a pump system comprising a motor and a pump, the manifold comprising hydraulic circuitry linking the pump system to the electrically powered actuator, and the pump system configured to pump hydraulic control fluid from a reservoir through the manifold to the actuator.

10. The system as recited in claim 9, wherein the manifold comprises at least one solenoid operated valve (SOV).

11. The system as recited in claim 8, wherein mechanical intervention for mechanically shifting the flow control valve can be performed while the electrically powered actuator is connected to the internal piston.

12. A method of operating a flow control valve, the method comprising:

powering up a pump system configured to pump hydraulic control fluid from a reservoir;

activating a selected solenoid operated valve (SOV) in a manifold comprising hydraulic circuitry linking the pump system with an electro-hydraulic actuator mounted externally to the flow control valve;

flowing the hydraulic control fluid from the reservoir, through the manifold, and into a chamber of the actuator such that a piston of the actuator moves in an open or a close direction; and moving a piston of the flow control valve by movement of the piston of the actuator;

wherein the SOV is a 3-way, 2-position, normally closed valve.

13. The method of claim 12, wherein the SOV acts as a directional switch.

14. A method of operating a flow control valve, the method comprising:

powering up a pump system configured to pump hydraulic control fluid from a reservoir;

activating a selected solenoid operated valve (SOV) in a manifold comprising hydraulic circuitry linking the pump system with an electro-hydraulic actuator mounted externally to the flow control valve;

flowing the hydraulic control fluid from the reservoir, through the manifold, and into a chamber of the actuator such that a piston of the actuator moves in an open or a close direction;

moving a piston of the flow control valve by movement of the piston of the actuator; and performing mechanical intervention on the actuator by using a shifting tool to mechanically move the piston of the actuator.

15. A flow control valve comprising:

a housing;

a piston movably disposed within the housing to adjust flow through the flow control valve;

at least one groove formed in an outer surface of the housing, the at least one groove housing an electrically powered actuator; and a linkage coupling the actuator to the piston such that movement of the actuator causes movement of the piston;

wherein the actuator comprises an electro-hydraulic actuator comprising an internal piston, wherein movement of the internal piston of the electro-hydraulic actuator causes movement of the piston of the flow control valve to adjust flow through the flow control valve.

16. The flow control valve of claim 15, wherein the at least one groove comprises a first groove housing the actuator and a second groove housing electronics.

* * * * *